US005937760A

United States Patent [19]

Yoshimori et al.

[11] Patent Number: 5,937,760

[45] Date of Patent: Aug. 17, 1999

[54] METHOD AND DEVICE FOR MOUNTING A LITHOPLATE USING REGISTER PINS

[75] Inventors: Taizo Yoshimori; Koji Okazaki; Eiji Miyoshi; Tetsunobu Murakata; Satoshi Kume; Keisuke Iguchi, all of Tokyo, Japan

[73] Assignee: Mitsubishi Paper Mills, Limited, Tokyo, Japan

[21] Appl. No.: 08/933,243

[22] Filed: Sep. 18, 1997

Related U.S. Application Data

[63] Continuation of application No. 08/616,515, Mar. 19, 1996, abandoned.

[51] Int. Cl.[6] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 751,345 | 6/1904 | Mestre | 101/415.1 |
| 2,579,517 | 12/1951 | Rowell et al. | 101/415.1 |
| 3,154,012 | 10/1964 | Fischer | 101/415.1 |
| 4,596,188 | 6/1986 | Bonomi | 101/415.1 |
| 4,977,833 | 12/1990 | Inage et al. | 101/415.1 |
| 5,473,407 | 12/1995 | Fuchioka et al. | 101/415.1 |

FOREIGN PATENT DOCUMENTS

| | | | |
|---|---|---|---|
| 623915 | 7/1927 | France | 24/67.3 |
| 886311 | 8/1953 | Germany | 101/415.1 |
| 888250 | 8/1953 | Germany | 101/415.1 |
| 2437758 | 2/1976 | Germany | 101/415.1 |
| 2522061 | 11/1976 | Germany | 101/415.1 |
| 6711999 | 3/1969 | Netherlands | 101/415.1 |

*Primary Examiner*—Ren Yan
*Assistant Examiner*—Daniel J. Colilla
*Attorney, Agent, or Firm*—Pillsbury, Madison & Sutro LLP

[57] ABSTRACT

A mounting device of a lithoplate, having a head clamp and a tail clamp of a lithoplate provided at a cutout portion of a plate cylinder, includes a register pin fixed to a lower blade of the head such that it penetrates through and projects from an upper blade of the head clamp. A clamp provided to the mounting device of a lithoplate includes a clamp having a register pin at an upper surface of an upper blade of the clamp and a roller which can freely rotate is provided at the position of a plate cylinder side opposed to the register pin. The mounting device of a lithoplate also includes a device for covering at least a part of a lithoplate holding tail edge at a region between a tip of a vise at a tail side and a plate cylinder to which no pressure is applied.

8 Claims, 9 Drawing Sheets

Fig. 1
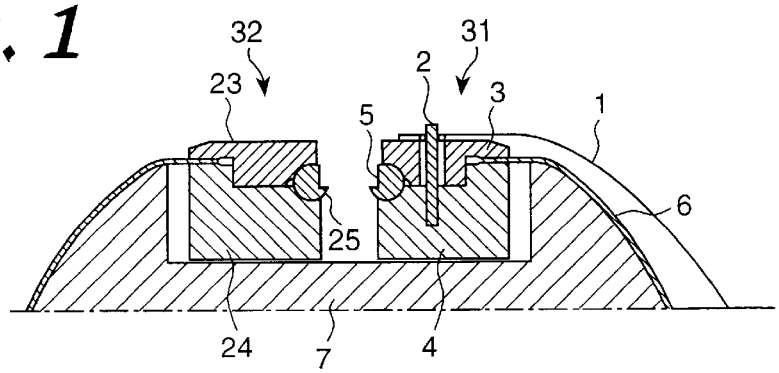
Fig. 2
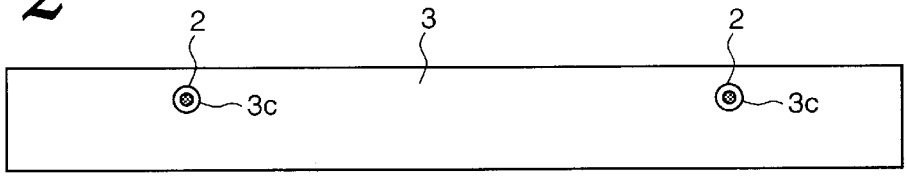
Fig. 3D
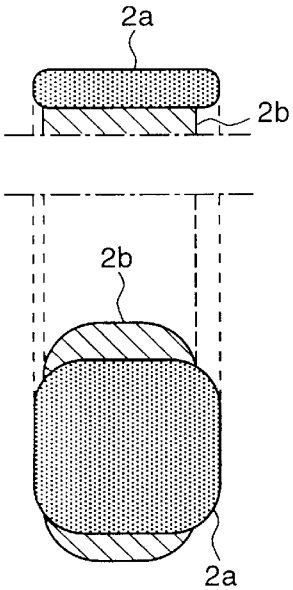
Fig. 3A
Fig. 3E
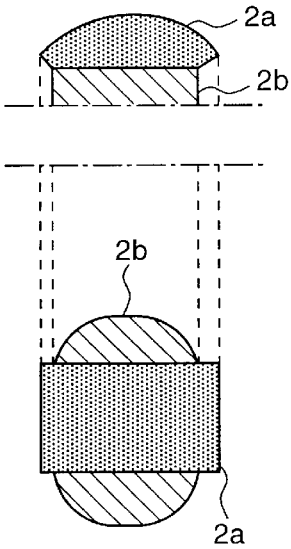
Fig. 3B
Fig. 3F
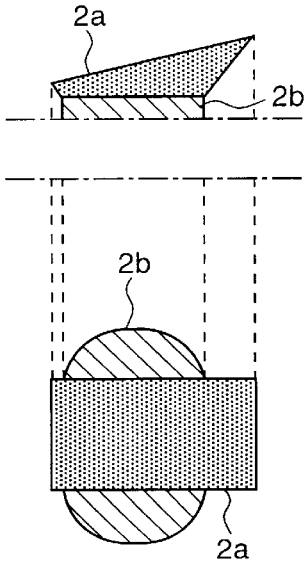
Fig. 3C

METHOD AND DEVICE FOR MOUNTING A LITHOPLATE USING REGISTER PINS

This is a continuation of application No. 08/616,515, filed on Mar. 19, 1996, which was abandoned upon the filing hereof Sep. 18. 1997.

BACKGROUND OF THE INVENTION

1. Field of the Invention

This invention relates to a mounting device of a lithoplate to be mounted onto a plate cylinder of an offset press, and more specifically, it relates to a mounting device such as a clamp, positioning (or register) device, or the like, of a lithoplate.

2. Description of the Related Art

As a base material of a lithoplate to be used for lithographic printing, in addition to a metal base such as aluminum to be used as a PS plate, there are paper, a synthetic resin film, or the like, to which a water-proof treatment has been performed. They are widely used in view of their advantages in simplicity and ease of preparation thereof and used for various applications depending on their properties.

A PS plate can effect printing of close to 10 times the number of printed sheets as compared with a paper plate, but it is expensive. Therefore, in recent years in the field of light printing in which the number of printed sheets is not great, a paper plate, or a film plate, has been widely used.

A paper plate, or a plastic plate, is weaker in body or strength as compared with that of a PS plate, and cannot be directly fitted to a plate cylinder as is the case with the PS plate. When these plates are fitted to a plate cylinder, a head edge and a tail edge of a lithoplate are fixed with a vise, and the plate is fixed on a plate cylinder by applying tension, but the strength of the base is weak so that there is a problem of stability. Even if they can be fitted directly on a plate cylinder, wrinkles or creases are likely caused thereon when positioning adjustment of the printing plate is carried out after fitting it on the plate cylinder. Thus, they cannot be used in practical applications.

In order to solve the above problems, a method has been proposed in which a paper plate or a plastic film (particularly a polyester film) plate is not directly fitted on a plate cylinder. Instead, a plate cylinder packing comprising a PS plate, etc. is first fitted on a plate cylinder, a paper plate or a plastic film plate is fitted thereon or adhered thereto, and the plate cylinder packing is moved whereby positioning adjustment of the lithoplate is realized.

There has also been known a method in which a lithoplate attachment plate, or a lithoplate register pin (hereinafter sometimes referred to as "a register pin"), and a lithoplate holding plate are provided onto an upper blade of a clamp at the side of holding to which plate cylinder packing is fitted. Such methods are disclosed in, for example, Japanese Utility Model Publication No. 11782/1994 and Japanese Utility Model Laid-Open Publication No. 19037/1991.

FIG. 11 is a partial sectional view of a plate cylinder of a printing machine relating to Japanese Utility Model Publication No. 11782/1994 and Japanese Utility Model Laid Open Publication No. 19037/1991. In FIG. 11, in a cutout (notch) portion of a plate cylinder 7, a clamp 31 at a head holding portion and a clamp 32 at an end holding portion are contained. Each of the clamps mainly comprise upper blades 3 and 23, lower blades 4 and 24 and cams 5 and 25, respectively. The upper blades 3 and 23 are opened or closed by rotating the cams, respectively.

Since a lithoplate 1, having weak body or strength as in a paper plate or a film plate, cannot be directly fitted on the plate cylinder 7 as mentioned above, a plate cylinder packing 6 constituted by a PS plate, etc. is previously held to the plate cylinder 7 by holding with both clamps 31 and 32 at the head holding portion and the end holding portion, and a lithoplate 1 such as a paper plate of a film plate is adhered with paste, double-sided adhering tape or the like onto the lithoplate to fit the plate on the plate cylinder 7 through the plate cylinder packing 6.

In the above publications, as a positioning standard for a lithoplate, a register pin 2 is provided to an upper blade 3, and fixed to the clamp 31 at the head holding portion. The register pin 2 is inserted into a pin hole 1*c* of the lithoplate 1, and the lithoplate 1 is adhered to the plate cylinder packing 6.

However, the above method involves the problems that positioning error is caused at an upper blade 3 of a clamp 31 when fitting and removal of the clamp 31 at the head holding portion are repeated for changing a plate cylinder packing 6 whereby deviation occurs at the register pin provided onto the upper blade 3 of the clamp 31.

Thus, in a lithoplate mounting device using the conventional plate cylinder packing, it is laborious and time consuming to position the lithoplate comprising a paper plate or a film plate when the lithoplates are frequently changed. In multicolored printing, particularly in color printing, positioning of lithoplates is extremely important and it is strongly desired to overcome the above problems.

Also, at a lithoplate fitting operation, there is a problem that a lithoplate 1 rises and comes off of the register pin when inserting the pin hole of the lithoplate onto the register pin or adhering to a plate cylinder packing after insertion. In the above prior art, a lithoplate holding plate 8*a* is provided to prevent the above problem, but it is insufficient for accelerating and simplifying the fitting and removing operation of the lithoplate at the time of changing thereof. Particularly, when removing the lithoplate, it is difficult to remove it from the register pin so that, in the case of a paper plate, it is possible to remove the paper plate therefrom by breaking the plate around the pin hole, but then the paper plate cannot be used again after removal thereof. In the case of a film plate, breakage of the plate around the pin hole is not easy and removal thereof requires much labor. Therefore, it has been desired to overcome these problems.

On the other hand, a direct lithoplate utilizing a silver complex diffusion transfer method according to a scanning type exposure system has been developed in recent years. This lithoplate uses a paper or a film with a thickness of about 100 $\mu$m as a support in relation to a power output machine. In this case the body and strength are very weak as compared with the conventional paper plate or film plate. Thus, it has also been desired to develop a smooth and rapid mounting device for inserting a lithoplate comprising the conventional paper plate or film plate with a relatively thick plate as well as a thinner lithoplate.

Further, in the above prior art method, the tail edge of the lithoplate is in a tail free state (also referred to as unfixed state or free end). That is, a length of the plate in the printing direction, i.e., a length between the head and bottom direction is set so that the end of the lithoplate is within the region to which ink is applied. By employing the above constitution, an operation of holding the lithoplate can be simplified and the size of the lithoplate can be made small. When the size of the lithoplate is small, there are advantages of not only saving lithographic materials, but also in the resulting wide flexibility when selecting a size of an output device of a lithoplate.

However, when the tail edge has a tail tree configuration, "rising" or floating up of the lithoplate end cannot be completely prevented. Also, there is a possibility of causing a problem that the lithoplate becomes caught under an ink roller when a printing machine is required to be rotated in reverse direction while winding the lithoplate, e.g., changing the lithoplate in a multi-color printer. Further, there is a problem that ink accumulates due to a bump at the tail edge of the lithoplate at the region in which ink roller pressure is applied onto the plate cylinder.

As a method for preventing "rising" of the tail edge of the lithoplate, there is disclosed a method in Japanese Utility Model Laid-Open Publication No. 88738/1991 that a holding mechanism (a clamp plate and a holding plate) is provided on an upper blade of a vise at the tail edge of the plate cylinder. In this method, however, there is a problem that insertion of the lithoplate tail edge into the holding mechanism is a troublesome operation. Further, in this method, the size of the lithoplate should be longer in the top to bottom direction than the regular lithoplate which is held to the plate cylinder by using a vise. This means there is a problem that a greater amount of plate material is required as well as the lithoplate is out of the range of the regular size or output of general applications.

SUMMARY OF THE INVENTION

A first object of the present invention is to provide a mounting device of a lithoplate which cancels positioning error of a register pin and can effect precise mounting of the lithoplate.

A second object ot the present invention is to provide a mounting device of a lithoplate which can effect mounting and detaching of the lithoplate rapidly and easily.

A third object of the present invention is to provide a clamp which can mount a lithoplate having weak body and strength such as a paper plate or a film plate rapidly and smoothly, and can prevent the tail edge of the mounted lithoplate from rising.

A fourth object of the present invention is to provide a mounting device of a lithoplate which can prevent the tail edge of the mounted lithoplate from "rising" to an extent that no problem substantially occurs when printing without impairing ease and simplicity of the mounting method and providing flexibility of lithoplate size and a method of mounting the same.

The above objects of the present invention can be accomplished by a mounting device of a lithoplate having a head clamp and a tail clamp of a lithoplate provided at a cutout portion of a plate cylinder, which comprises a register pin fixed to a lower blade of the head clamp and the register pin penetrates through and projects from an upper blade of the head clamp.

Also, a clamp provided to a mounting device of a lithoplate of the present invention comprises a clamp having a register pin at an upper surface of an upper blade of the clamp and a roller which can freely rotate being provided at the position of a plate cylinder side opposed to said register pin (or before the register pin to the lithoplate inserting direction).

Further, a mounting device of a lithoplate for preventing a lithoplate tail edge from "rising", of the present invention, comprising a means for covering at least a part of the lithoplate holding tail edge at the region between the tip of a vise at the tail side and a plate cylinder to which no pressure is applied. As a means for covering the lithoplate holding tail edge, by using a plate member which is projected 5 mm or more from the head edge of the upper blade of the vise at the tail side and fixed to the upper blade, the object of the present invention can be more reliably carried out.

Moreover, a method of mounting a lithoplate comprising a paper or resin film to a lithographic printer which comprises covering at least a part of a lithoplate holding tail edge of a lithoplate at the region between the tip of a vise at the tail side and a plate cylinder to which no pressure is applied, by using a means capable of covering the lithoplate comprising a paper, a plastic film, a metal film and a composite film of a plastic and/or metal and a paper.

BRIEF DESCRIPTION OF THE DRAWINGS

FIG. 1 is a partial sectional view of a plate cylinder of a press according to the present invention;

FIG. 2 is a plan view of a head clamp of FIG. 1;

FIGS. 3A, 3B and 3C are plan views of head portions of register pins according to the present invention;

FIGS. 3D, 3E, and 3F are sectional views corresponding to FIGS. 3A, 3B, and 3C, respectively;

DESCRIPTION OF THE PREFERRED EMBODIMENTS

In the following, the present invention will be explained in more detail.

The mounting method of the present invention is preferably applied to a paper plate or a resin film plate having weak strength as compared with an aluminum plate such as a PS plate, etc., and can be applied to a method in which a paper plate or a film plate is directly mounted to a plate cylinder and a method in which such a plate is mounted by interposing a support such as a plate cylinder packing between the plate cylinder and a lithoplate. The method of the present invention can be preferably applied to the latter method and the following explanation is carried out based on this embodiment.

The paper plate or the resin film plate to be used in the present invention is a lithographic printing plate using, as a base or support, a paper, or one surface or both surfaces of a paper is/are coated with a thermoplastic resin such as a polyethylene or the like, or a plastic resin film such as a polyester or the like.

As a support or packing to be interposed between the paper plate or the resin film plate and a plate cylinder, there may be used an aluminum base plate, a metal plate, a reinforced film or the like. In general, a used aluminum-based PS plate is preferable as a support or packing component.

A characteristic feature of a mounting device of a lithoplate having a register pin in the first embodiment of the present invention resides in fixing the register pin-to a lower blade of a holding side clamp, whereas in the conventional device it is fixed to an upper blade of the same. By fixing the register pin to the lower blade in the present invention, misregistering the register pin does not occur so that the register pin can play an important role in printing.

Figure 10:
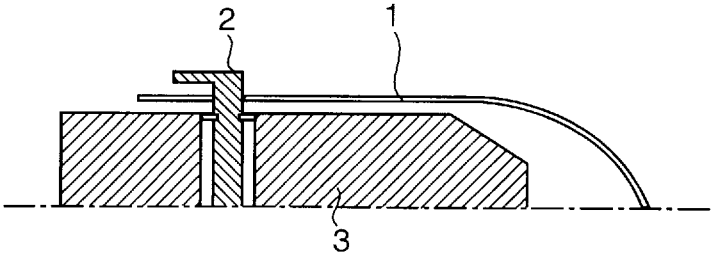
FIG. 10 is a partial sectional view of an example in which a head portion of a register pin is made with a reverse L-shape.
Figure 11:
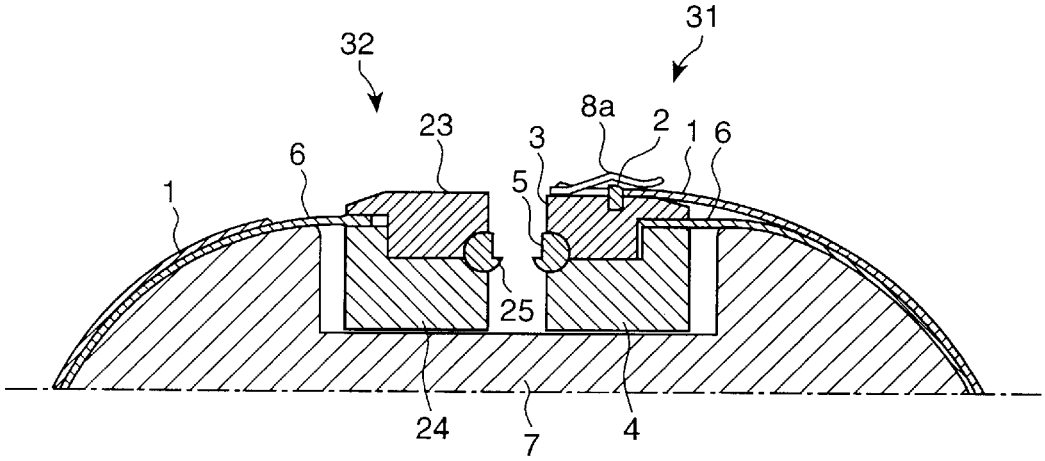
Fig. 11 (PRIOR ART)
FIG. 11 is a partial sectional view of a plate cylinder of a conventional lithographic printer.

In the present invention, the first object is to prevent positioning error of a register pin and to effect mounting of the lithoplate always precisely as mentioned above. In this sense, a means for mounting a lithoplate is not particularly limited so long as the register pin is fixed to a lower blade of a clamp. There may be employed various means in which, for example, a holding plate 8*a* is provided as described in Japanese Utility Model Publication No. 11782/1994, as shown in FIG. 11, or a hook stopper for preventing lithoplate from rising is provided at a head portion of a register pin, as described in Japanese Utility Model Laid-Open Publication No. 19037/1991, or as another means, a head portion of the register pin having a reverse L-shape as shown in FIG. 10, or a means of fixing a lithoplate onto the upper surface of an upper blade of a clamp with double-sided adhesive tape.

On the other hand, another aspect of the invention is to provide a mounting device of a lithoplate which can effect mounting and detaching of the lithoplate rapidly and easily. This is the second object of the invention. By employing the following constitution, a more available device can be obtained.

That is, the merits are to prevent a lithoplate from rising from a register pin when the lithoplate is mounted and to make the detaching operation rapid and easy when the lithoplate is replaced. As one of the preferred embodiments thereof, a portion of the register pin that projects from an upper blade of a clamp allows insertion into a pin hole of the lithoplate, and the shape or structure of the portion is so made that maintaining the state of the lithoplate, and detaching it, is possible.

That is, the register pin and the pin hole of a lithoplate are in the relationship that the former can be inserted into the latter, and once it is inserted, such a state can be maintained (otherwise the lithoplate is artificially taken off or removed from the register pin, i.e., it cannot be easily taken off), and when the lithoplate is to be taken off, the inserted state can be canceled whereby the lithoplate can be easily taken off.

As the second means, a tool is provided which is capable of fixing a lithoplate, a pin hole of which is fitted with the register pin onto an upper blade of a clamp, and canceling the fixed state.

The above embodiments are described in detail below by referring to the drawings. FIG. 1 is a partial sectional view of a plate cylinder of a printer according to the present invention, and FIG. 2 is a plan view of a holding side clamp of FIG. 1.

In these figures, a register pin 2 or a lithoplate 1 is fixed to a lower blade 4 of a holding side clamp 31, and penetrates through an upper blade 3 and projects therefrom. Here, in relation to the register pins 2, through holes 3*c* provided at the upper blade 3 are provided a certain distance as shown in FIG. 2. That is, the distance of the register pins 2 and the through holes 3*c* is provided to facilitate opening and shutting the upper blade 3 when plate cylinder packing 6 is mounted to the clamp 31 or detached therefrom.

At least two of the register pins 2 are required in the longitudinal direction of the plate cylinder 7. In FIGS. 1 and 2, an example of the case with two register pins 2 is shown, but the number of the register pins can be optionally selected depending on the size of the printer or the lithoplate, or the like.

Next, a means for preventing rising of the head side of the lithoplate 1 from the register pin 2 when the lithoplate 1 is mounted to the plate cylinder 7, and making the removal of the lithoplate 1 quick and easy when the lithoplate is to be changed, is explained below.

The first means thereof is a constitution that a portion of the register pin 2, that projects from an upper blade 3 of a clamp 31 allows insertion into a pin hole 3*c* of the lithoplate 1, and the shape or structure of the portion is so made that maintaining the inserted state and allowing detachment is possible. FIGS. 3A–3F, 4A and 4B are drawings showing embodiments in which a characteristic feature thereof resides in the shape of the head portion of the register pin and FIGS. 5A, 5B, 6A and 6B are drawings showing constitutions in which the register pin has the above-mentioned function.

Figure 4A:
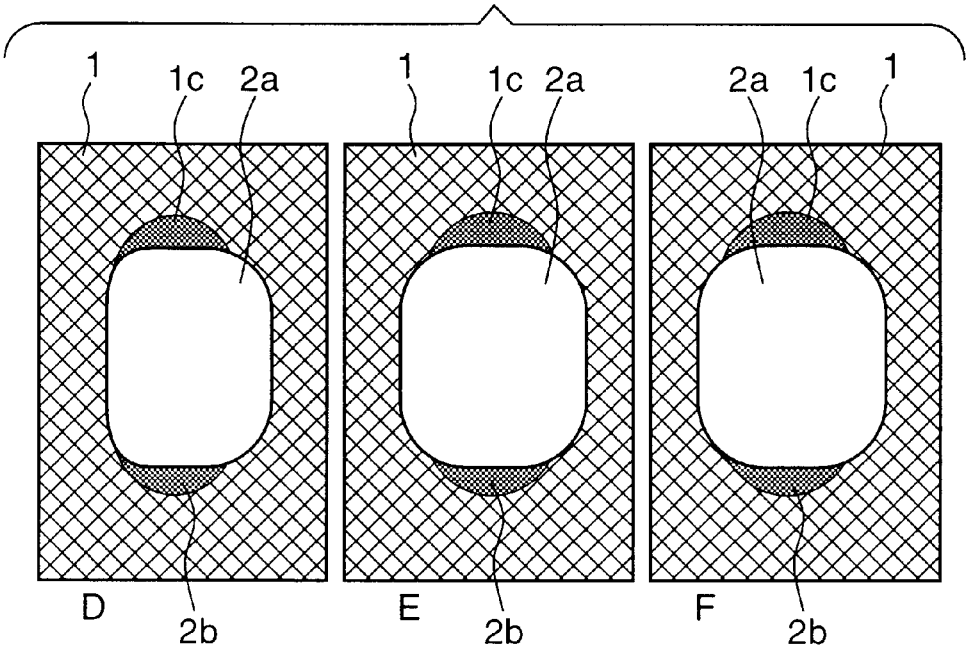
FIGS. 4A and 4B illustrate inserting a lithoplate into a register pin of FIG. 3A.
Figure 4B:
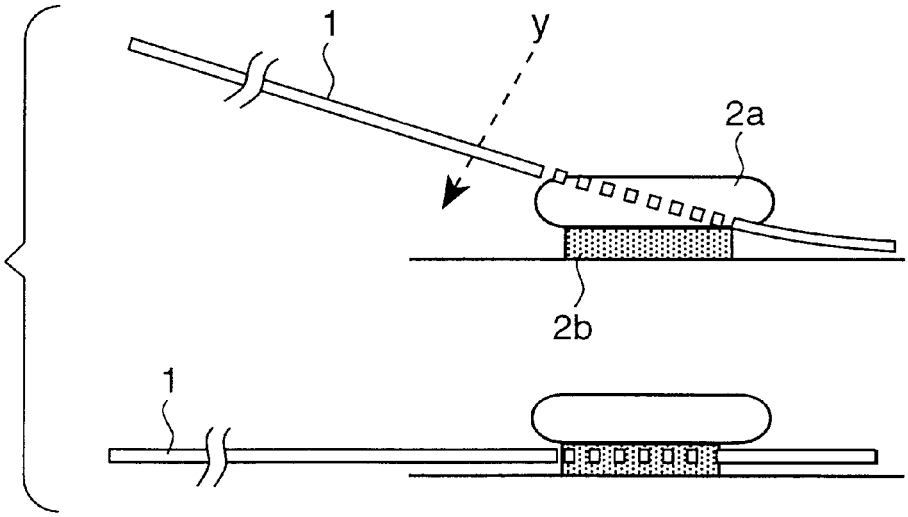

FIGS. 3A–3C and 3D–3F show plan views and side views, respectively, of various kinds of head edges of register pins 2 that project over the upper blade 3 of the clamp 31. The lower portion 2*b* of the register pins 2 that project over the upper blade 3 are fitted to a pin hole of the lithoplate 1, and the shape of the head edge 2*a* of the register pin is such that it is longer than that of the lower portion 2*b* in the circumferencial direction of the plate cylinder 7, and shorter than that of the same in the horizontal direction of the same. FIGS. 4A and 4B are plan views and side views of the state when a pin hole 1*c* of the lithoplate 1 is fitted with the register pin 2, respectively. The pin hole 1*c* of the lithoplate 1 does not allow insertion of the head portion of the register pin in the orientation as shown in these views. However, the pin hole permits the head portion to pass through when the head portion has a shape that can pass through the pin hole if the lithoplate 1 is fitted in inclined state. That is, a lithoplate such as a paper plate or a film plate can be deformed flexibly so that even if the size of the pin head portion is larger than the size of the head that the pin hole can theoretically allow to pass, the pin can be inserted into the pin hole in a manner similar to buttoning a shirt. In FIGS. 4A and 4B, when one attaches the lithoplate 1 to the pin 2 in the direction y, the pinhole 1*c* of the lithoplate 1 is fitted to the pin 2 in the order of D, E and F of FIG. 4A. Once the lithoplate is inserted onto the pin, it cannot easily be taken off. When it is to be taken off, it can be easily removed by the operation which is the reverse of the insertion. In FIGS. 3A–3F, 4A and 4B, the shape of the lower portion 2*b* of the pin is made to be elliptical, but a circular shape is also suitable.

Figure 5A:
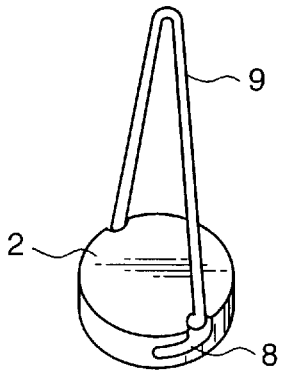
FIGS. 5A and 5B are perspective views of a head portion of a register pin according to a preferred embodiment of the present invention.
Figure 5B:
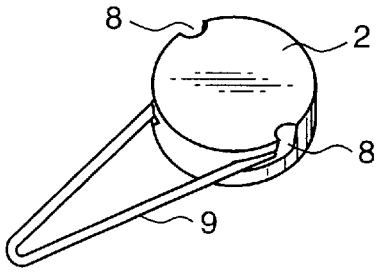

FIGS. 5A and 5B are perspective views of the portion of a register pin 2 that projects from an upper blade 3 of the clamp 31. The register pin 2 has a V-shaped pin 9, a groove 8 which allows the V-shaped pin 9 to be freely raised and lowered, and a hole (not shown) for accommodating both bent-end portions of the V-shaped pin 9, and a spring force that results from putting the register pin 2 between both ends of the V-shaped pin 9.

When the pin hole 1*c* of the lithoplate 1 is inserted over the register pin 2, the V-shaped pin 9 is fixed in a raised state in the vertical direction and after insertion of the lithoplate 1, the V-shaped pin 9 is lowered thereby preventing the lithoplate 1 from rising from the register pin 2. Also, when the lithoplate 1 is to be removed, it can be easily removed therefrom by raising the V-shaped pin 9.

Figure 6A:
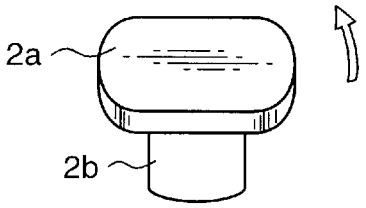
FIGS. 6A and 6B are perspective views ot a head portion of a register pin according to another preferred embodiment of the present invention.
Figure 6B:
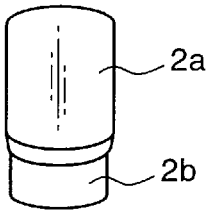
Figure 7:
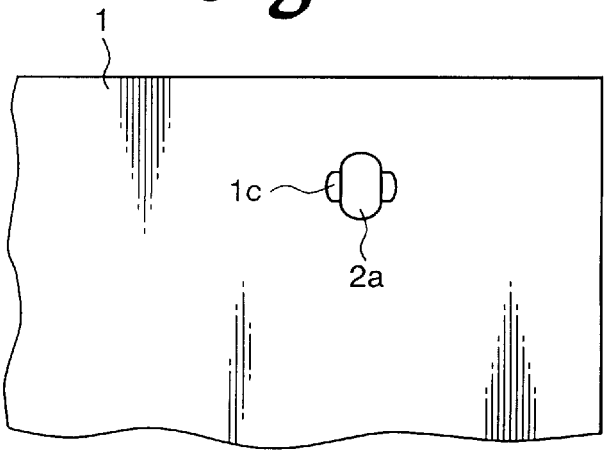
FIG. 7 is a partial plan view of the state in which a lithoplate is inserted into a register pin of FIGS. 6A and 6B.

Another embodiment different from FIGS. 5A and 5B is shown in FIGS. 6A and 6B. FIGS. 6A and 6B are perspective views of the register pin 2 projected from an upper blade 3 of the clamp 31. The upper surface of the head portion of the register pin 2 is an ellipse and is a double structure of a head portion 2*a* and a lower portion 2*b*, and the center portion of the head portion 2*a* is supported (not shown) by the lower portion 2*b*, the head portion 2*a* freely turns on the axle. A pin hole of the lithoplate is an ellipse so as to fit to the head portion 2*a* of the register pin 2. FIG. 6B is a drawing showing the state that the head portion 2*a* of FIG. 6A is rotated in a 90° arc. After fitting the pin hole of the lithoplate with the register pin, rising of the lithoplate is prevented by rotating the head portion 2*a* of the pin in a 90° arc. A partial plan view showing the state that the lithoplate fitted with the register pin is shown in FIG. 7. In this figure, the head portion 2*a* of the pin is rotated in a 90° arc whereby rising of the pin hole 1*c* of the lithoplate 1 from the register pin 2 is prevented. Also, when the lithoplate is to be removed, by rotating the head portion 2*a* of the register pin in a 90° arc to return the original position, it can be easily removed therefrom.

Next, as the second means for preventing a lithoplate from rising off a register pin, thus accelerating and facilitating removal, an embodiment in which a tool which can fix a lithoplate to an upper blade of a clamp, and also remove it, is provided and will be explained next.

Figure 8A:
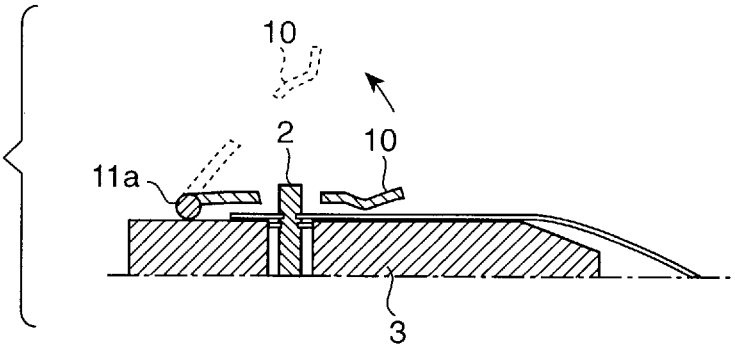
FIGS. 8A and 8B are partial sectional and plan views when a holding plate is provided to an upper blade of a clamp, respectively.
Figure 8B:
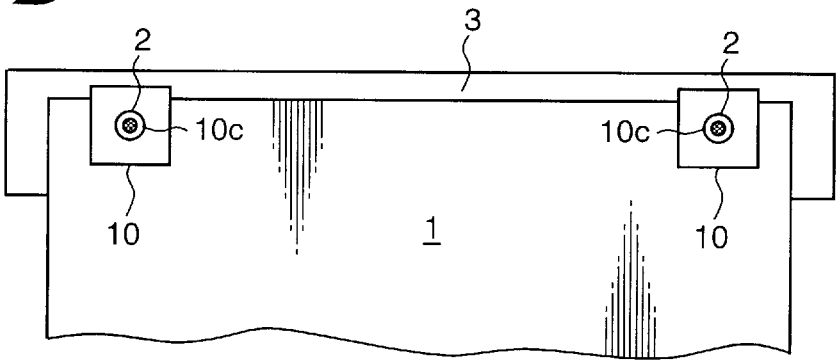

FIG. 8A is a partial sectional view of an embodiment in which a holding plate is provided at an upper surface of a clamp upper blade 3, and the holding plate 10 having a pin hole(s) 10*c* which fits with a register pin 2 is supported by a pintle interposing a spring 11*a* to the clamp upper blade 3. The spring 11*a* so works that the holding plate 10 presses the clamp upper blade 3 whereby rising of the lithoplate 1 is prevented. The holding plate 10 can be freely attached to and detached from the clamp upper blade as a matter of course, and the lithoplate 1 can be easily attached or detached. The holding plate 10 may be provided with the whole length to the longitudinal direction of the clamp upper blade 3, but as shown in FIG. 8B, it may be provided fragmentarily, e.g., only at the portion where the register pin 2 is provided.

Figure 9:
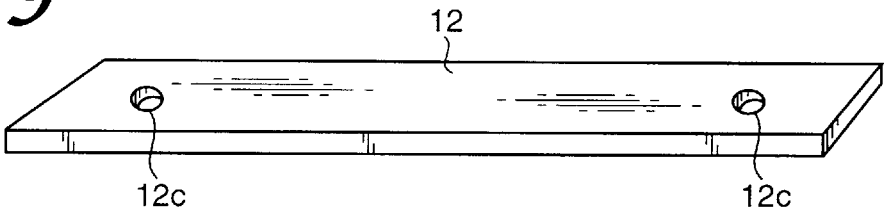
FIG. 9 is a perspective view of a pin bar.

FIG. 9 is a perspective view of a pin bar. The pin bar 12 has pin holes 12*c* which fit with register pins, and by mounting the pin bar 12 over the lithoplate, initiation and cancellation of the fixed state can be carried out with a magnet(s), a screw(s) or the like (not shown). As for the pin bar 12, it may be provided with the whole length in the longitudinal direction of the clamp upper blade as in the holding plate, but it may be provided fragmentarily, e.g., only at the portion where the register pin 2 is provided.

In a further embodiment of the present invention, a clamp provided to a mounting device of a lithoplate of the present invention is to quickly and smoothly mount a lithoplate having weak body or strength such as a paper plate and a film plate to a register pin at the upper surface of a clamp upper blade and further to prevent rising of the head edge of the lithoplate, and the characteristic feature thereof resides in providing a freely rotatable roller in place of the conventional holding plate of a lithoplate.

That is, the roller acts as a guide when inserting a lithoplate so that even when a thin lithoplate is to be used, it can be smoothly inserted. Also, the roller acts as a material for holding down the lithoplate to prevent rising thereof after fitting a pin hole(s) of the lithoplate with a register pin(s).

Figure 12:
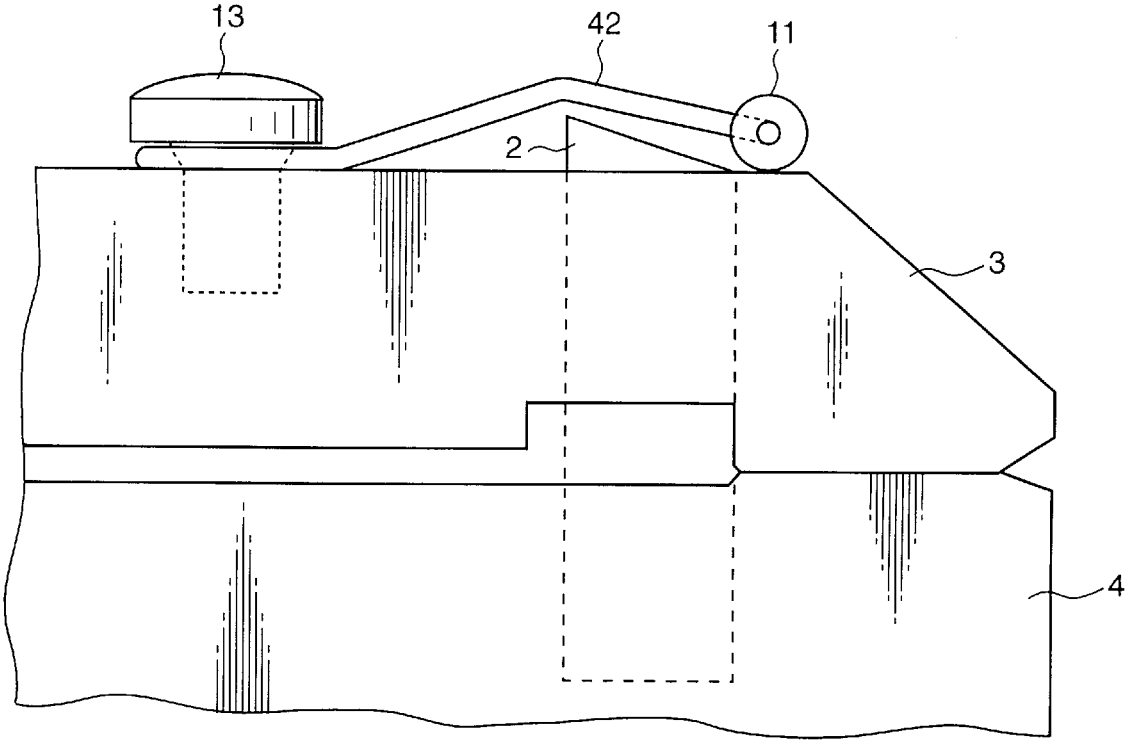
FIG. 12 is a side view of a clamp according to a preferred embodiment of the present invention.
Figure 13:
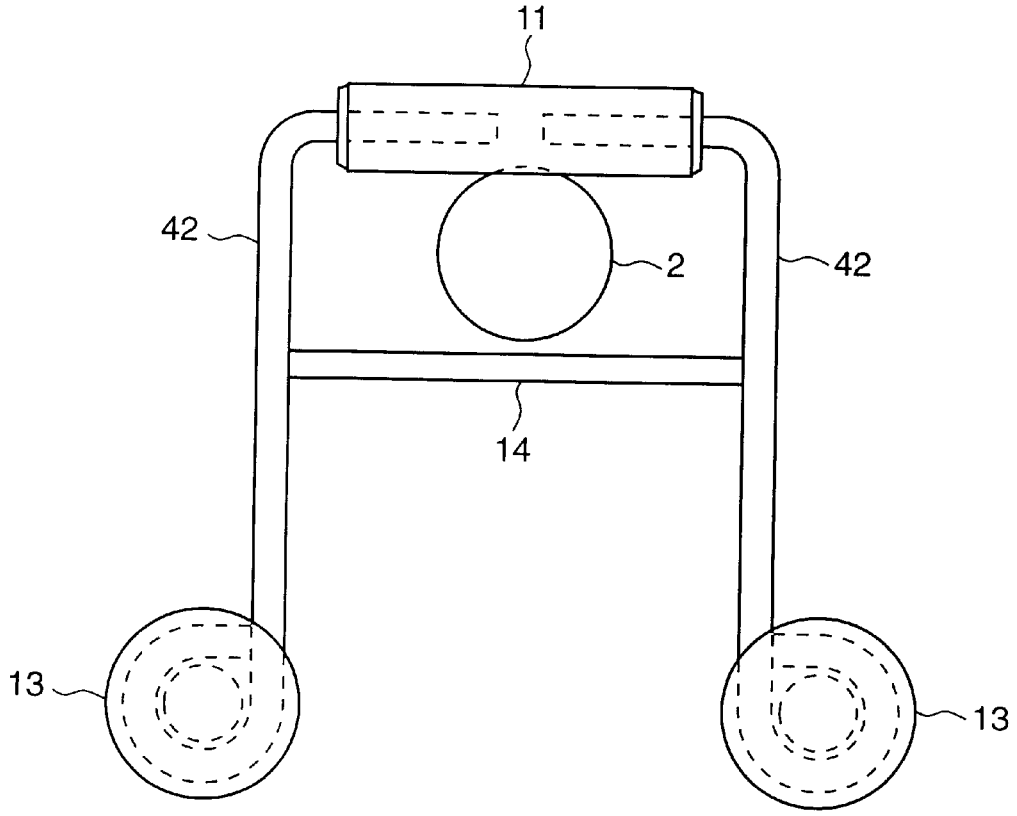
FIG. 13 is an upper view of a roller portion of FIG. 12.

In the following, the clamp of the present invention is explained in detail by referring to the drawings. FIG. 12 is a side view of the clamp portion of the present invention, and FIG. 13 is a plan view of the portion at which a roller is provided. At the upper surface of an upper blade 3 of the clamp, a register pin 2 is projected therefrom, and a roller 11 is placed nearer to a plate cylinder 7 side than the register pin 2 or before the register pin 2 to the lithoplate inserting direction. The roller 11 is supported by an arm 42 at an upper surface of the upper blade 3 of the clamp with the state that the roller can be freely rotatable. The arm 42 is fixed to the clamp upper blade 3 with a bolt 13. Here, the shape of the roller is not specifically limited but preferably a cylindrical or spherical shape. If it is freely rotatable, it may be a polygonal shape in sectional view.

To the arm 42, a spring force is preferably applied so that the roller 11 is pressed to the upper surface of the clamp upper blade 3 to a suitable degree, and a material having higher rigidity, to a certain extent, is preferred. When the arm 42 is formed in a L-shape, a spring force is easily applied to the upper surface of the clamp upper blade 3. For holding both sides of arms 42 supporting the roller 11, a stay 14 may be provided as shown in FIG. 13. The register pin 2 is set at substantially the center portion of both sides arms 42 and the roller 11 is provided at the side of the plate cylinder relative to the register pin 2, or the roller 11 is provided before the register pin 2 to the lithoplate inserting direction.

The shape, or the like, of the register pin 2 is not particularly limited so long as it is so provided that the head portion thereof projects over the upper surface of the clamp upper blade 3. The register pin 2 preferably has an incline-shaped head, inclined to the plate cylinder side, as shown in FIG. 12. The register pin may be fixed to the clamp upper blade 3 or may be fixed to the clamp lower blade 4 or the plate cylinder 7 when the roller is provided. It is preferably so provided that the pin is fixed to the clamp lower blade, penetrated through the clamp upper blade and projected over the upper surface of the upper blade. The number of the register pins is not specifically-limited, but generally 2 or 3 is a suitable number.

Rollers may be provided at several portions, e.g., at the portion that the register pin is provided and the portion between the register pins. The number of rollers and the length of the rollers vary depending on the size of a printer. For example, in the case of printing a full sheet, rollers having a length of about 2 cm are provided at portions or so.

Figure 14:
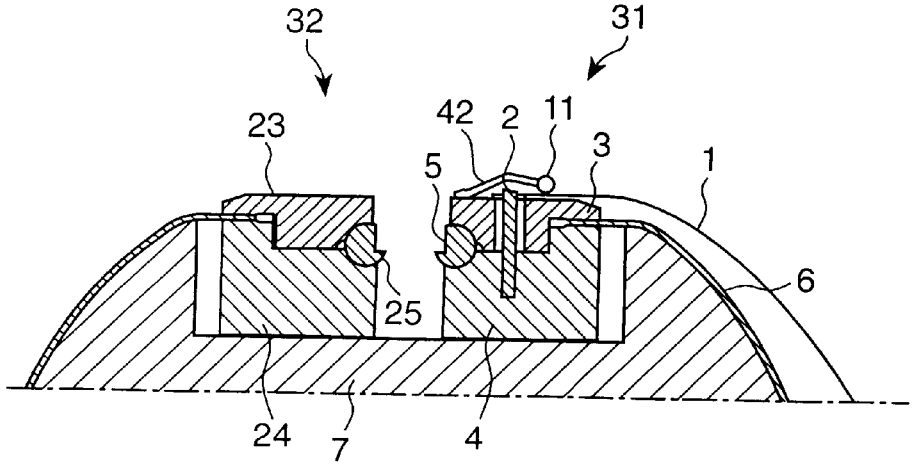
FIG. 14 is a partial sectional view of a lithographic printer using a clamp of the present invention.

Next, a mounting method of a lithoplate having weak body and strength such as a paper plate or a film plate by using the clamp of the present invention will be explained. FIG. 14 is a partial sectional view of a printer using the clamp of the present invention. A plate cylinder packing 6 such as a PS plate, etc. is mounted to a plate cylinder 7 by holding head and tail edges of the lithoplate to both clamps 31 and 32 (also referred to as "vises") at the holding side and the tail side. Next, pin holes of the lithoplate 1 are to be fitted with register pins provided at the upper surface of a clamp upper blade 3. At this time, by inserting the head edge of the lithoplate 1 along with rollers 11, the pin holes of the lithoplate can be fitted rapidly and easily with the register pins. Further, after inserting the lithoplate, the rollers act to prevent rising of the lithoplate so that the lithoplate can be easily mounted on the plate cylinder packing. The lithoplate can be mounted to the plate cylinder packing by adhering with paste, double-sided tape, or the like.

The plate end of the lithoplate may be a so-called "tail free" where the plate end holds on the plate cylinder packing or may be fixed to the end clamp by, for example, providing the above-mentioned roller at the upper surtace of the clamp upper blade 23 at the tail side.

In the further embodiment of the present invention, a mounting device of a lithoplate for preventing from "rising" of a lithoplate holding tail edge comprises having a means for covering at least a part of the lithoplate holding tail edge at the region from the tip of a vise at the tail side to a plate cylinder to which no pressure is applied.

In the present invention, a means for covering at least a part of the lithoplate holding tail edge is not particularly limited so long as it covers from an upper portion to stop rising or floating up of the tail edge of the lithoplate separating from the plate cylinder. It is preferably a rod-like member, or a flat plate member, each having a certain degree of strength, and more preferably a flat plate member of metal or plastic. In summary, the present embodiment is to prevent rising of the tail edge of the lithoplate at the region from the tip of a vise at the tail side to a plate cylinder to which no pressure is applied.

Figure 17:
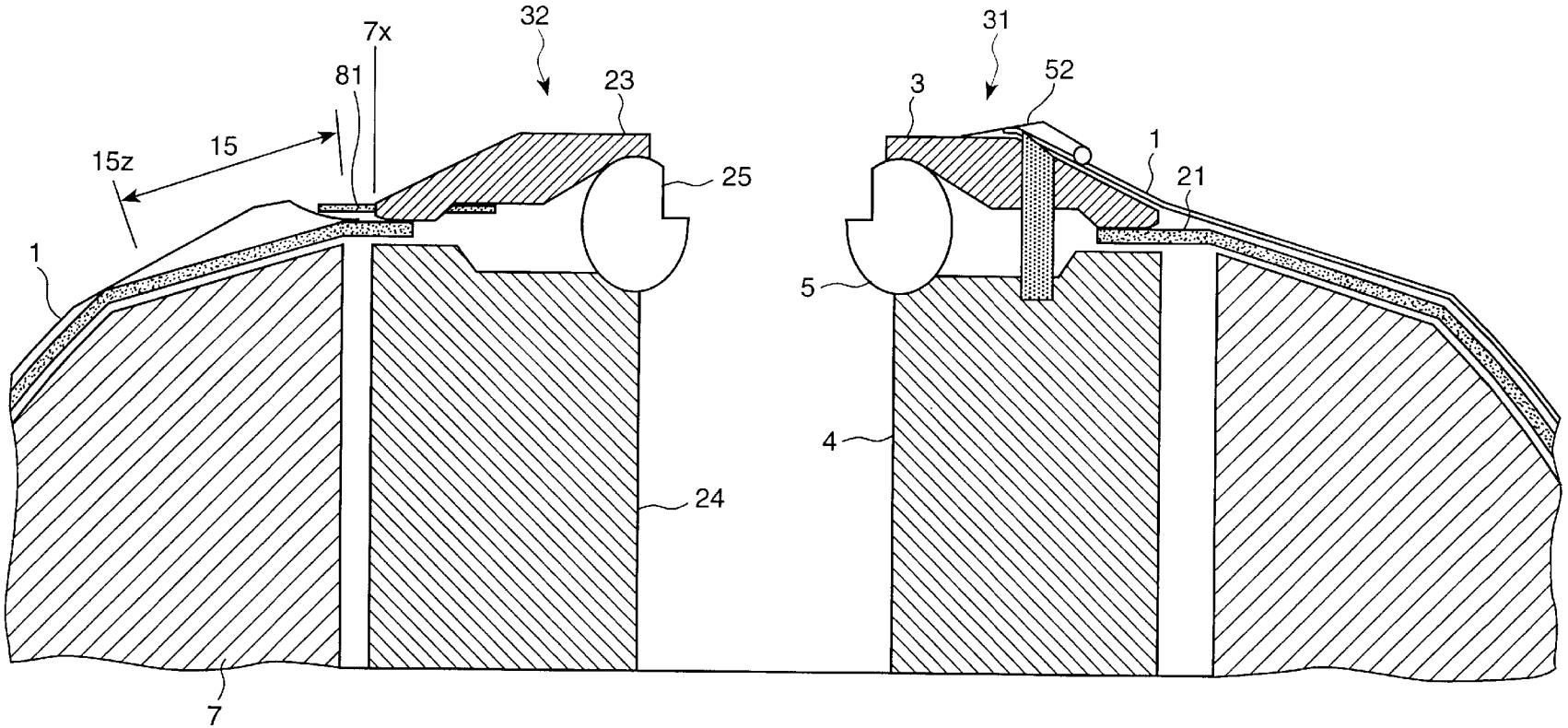
FIG. 17 is a sectional view in which a lithoplate is mounted according to the present invention.
Figure 20:
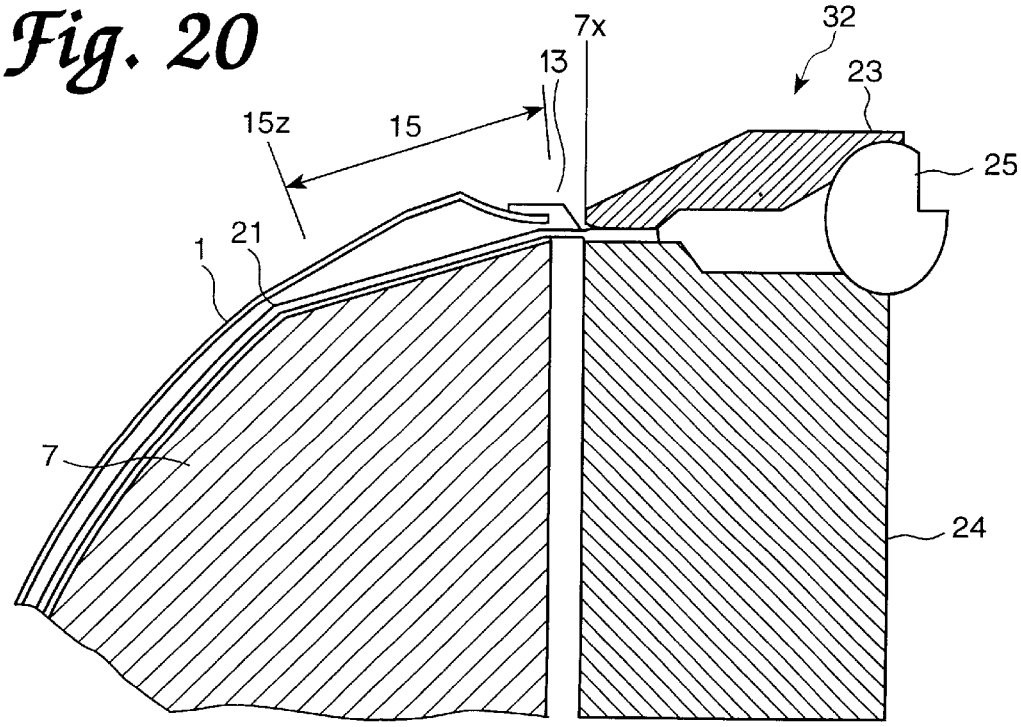
FIG. 20 is a sectional view in which a lithoplate is mounted according to the present invention.

The region to which no pressure is applied is a portion represented by the reference numeral 15 in FIGS. 17 and 20. In the present invention, the region to cover the tail edge of the lithoplate in order to prevent rising of said portion is from the tip of the vise at the tail side 7*x* to 15*z* which includes the region 15 to which no pressure is applied. In the present invention, when the region which covers the tail edge of the lithoplate is close to 15*z*, the size of the lithoplate is small but it likely becomes an obstacle when the tail edge of the lithoplate is to be inserted into the tail side of the vise. Thus, the region which covers the tail edge of the lithoplate is preferably close to 7*x*.

In the present specification, the term "covering at least a part of the tail edge of the lithoplate" means covering the whole portion in the width direction of the tail edge of the lithoplate, but covering may be carried out only partially over several portions. A preferred embodiment includes options which depend on the size (e.g., an A1 size paper) of the lithoplate, strength of the body (rigidity) or the like. Also, to cover the tail edge of the lithoplate may include to cover a lithoplate with a weak pressure depending on the conditions of covering.

As a means to cover the tail edge of the lithoplate, a method of fitting up a holding plate (hereinafter referred to as "plate") having a required strength in a shape projecting from the tip portion of the tail side vise or a neighbor thereof to the head portion can be used. The plate may be attached to cover from one end to another end in the width direction, but more desirably the plate is attached to cover the lithoplate at 3 to 5 positions. In this case, the width of the plate is preferably about 3 mm to 20 mm, and the length of the top and bottom direction in which the lithoplate is covered by the plate is preferably about 5 mm to 20 mm. In order to stably fix the tail edge of the lithoplate, the number and the size of the required plates depend on the depth of bending at the tail edge of the plate cylinder, a length from the portion to be bent to the tail edge of the lithoplate, and rigidity of the lithoplate itself.

The plate is so attached that a weak pressure is applied to the region between the support, and the lithoplate may be fixed in a manner of interposing it between the plate and the support. However, it is preferred that the plate is fitted up so as to cause a gap within 2 mm from the plate cylinder or the support, and the lithoplate is simply inserted into the gap since the operation is simple and easy.

When the plate is fixed with the support by the vise at the tail side, the plate has two elements: a portion which is held by the vise and a portion which is projected over the support and covers the tail edge of the lithoplate. Suitable difference in step is provided between the respective portions, so as to have a suitable distance between the portion which covers the tail edge of the lithoplate and the support. The thickness of the plate, in at least the region held by the vise, is the same as or slightly thinner than the support. Notches are provided at several portions of the tail edge of the support and the portion of the plate which is held by the vise is inserted into the notch portion so as to project the portion which covers the lithoplate to the printing surface direction.

When the plate is attached to the vise device, it is so attached as to cover from the upper side of an upper blade, or from the bottom side of the upper blade by cutting the joint portion with a lower blade, but the latter is preferred in view of mechanical stability. The plate may be freely attached or removed, and more desirably it is fixed to the upper blade for mechanical simplicity and for stability, and the size of the plate is selectable within the range which does not hinder usual lithoplate mounting operation. In this case, the plate is preferably so attached as to project 5 mm or more, more preferably 5 to 15 mm from the tip of the upper blade substantially horizontally to the holding surface.

Figure 15A:
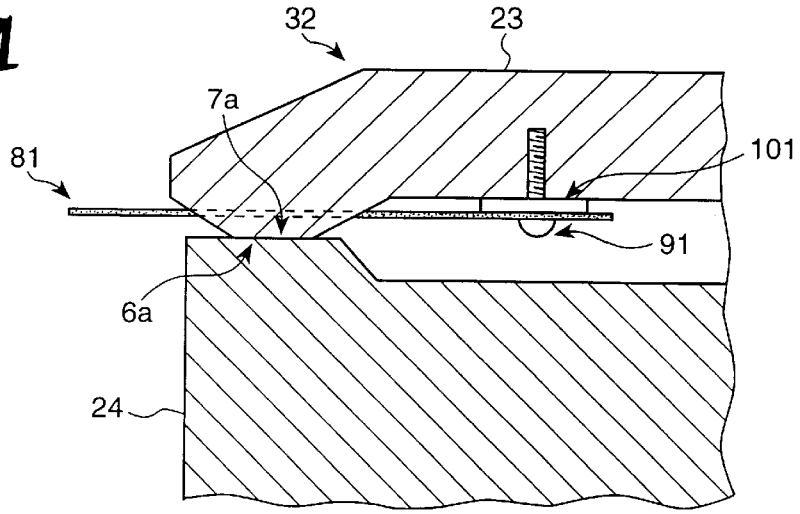
FIGS. 15A and 15B are side sectional views of a tail side vise which are embodiments of the present invention.
Figure 15B:
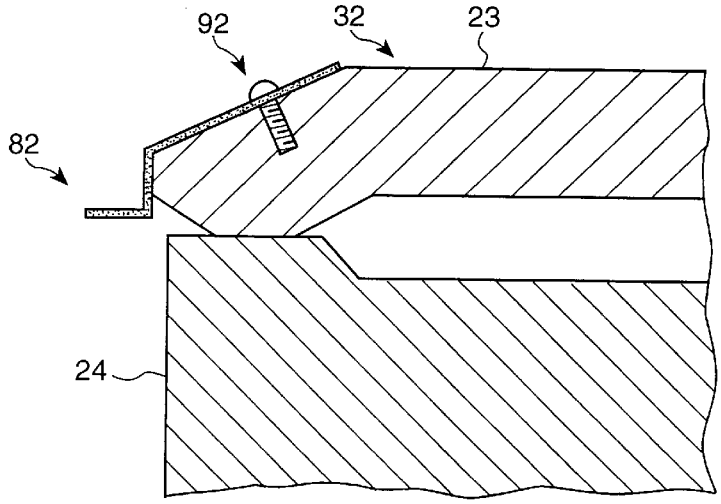
Figure 16:
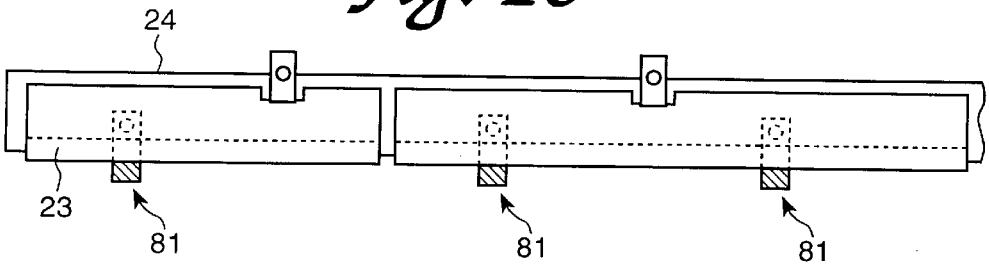
FIG. 16 is a plan view ot FIG. 15A.

In the following, an example of attaching the plate to the tail side of the vise is explained, but the present invention is not limited only to these embodiments. FIGS. 15A and 15B are side sectional views of the tail side vises to which the present invention is applied. FIG. 16 is a plan view of the tail side vise shown in FIG. 15A.

The plates 81 are attached to three portions in total at substantially the center portion of the vise with a width of 70 cm and the portions which are moved to center portion from both ends with a distance of about ⅕ or so of the width of the vise. The width of each plate is 10 mm and the plates are projected from the vise side to the plate cylinder about 10 mm. These plates with such a size do not hinder the lithoplate mounting operation using a usual lithoplate vise.

The plate is fixed with a bolt 92 from the lower side of the upper blade 23. Between the plate and the upper blade, a thickness adjusting plate 10 is inserted so that the distance between the plate and a joined surface 7*a* of the upper blade is adjusted to 0.5 mm. Among the joined surface 7*a* of the upper blade, a portion to which the plate is contacted is previously provided a notch which is a required size whereby the plate does not interfere joined surfaces 6*a* and 7*a* of the upper and lower blades. By providing the notch, in the case of mounting a lithoplate using a support, the support can be fixed to the vise as in the past, and the tail edge of the lithoplate mounted on the support can be covered by the plate 8 whereby rising can be prevented. Also, the plate acts in the same manner when a lithoplate is directly mounted to a plate cylinder without using a support.

FIG. 17 is a sectional view when a film base lithoplate 1 is actually mounted and rising of the tail edge of the lithoplate is prevented by the present invention. Here, a support 21 comprising a used PS plate is fixed on a plate cylinder with tension by fixing both ends of a holding head and a holding end with vises 32 and 5. To the back surface of the film base lithoplate 1 is previously formed an adhesive layer 31 by a spray bond. Upon fixing the head portion of the lithoplate to an exclusive fixing device 52 attached onto the vise, and under the conditions where a pressure is applied between a blanket cylinder and a plate cylinder, the plate cylinder 7 is rotated in a complete circle to adhere the lithoplate 1 to a support.

After adhering the lithoplate 1 to the region in which the lithoplate is bent at the tail edge of the plate cylinder, the tail edge of the lithoplate is finally inserted under the plate 81 in the region 15 on the plate cylinder to which no pressure is applied. As regards the size of the litho plate, the length is set so that the lithoplate is covered 5 mm or more by the plate 81. This is the same as or slightly less than the regular lithoplate size. Since the plate holds only part of the lithoplate, part of the tail edge of the lithoplate rises but the lithoplate is certainly contained within the plate cylinder diameter so that no problem occurs.

Next, FIG. 15B is explained below. The constitution of this example is the same as that of FIG. 15A except for changing the attached position of the plate 82 to the upper blade 23. In this example, the plate 82 is attached to the upper surface of the upper blade 23 and fixed by a bolt 92 thereto.

Figure 18:
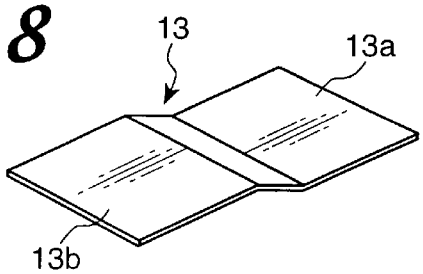
FIG. 18 is a perspective view of a plate according to the present invention.
Figure 19:
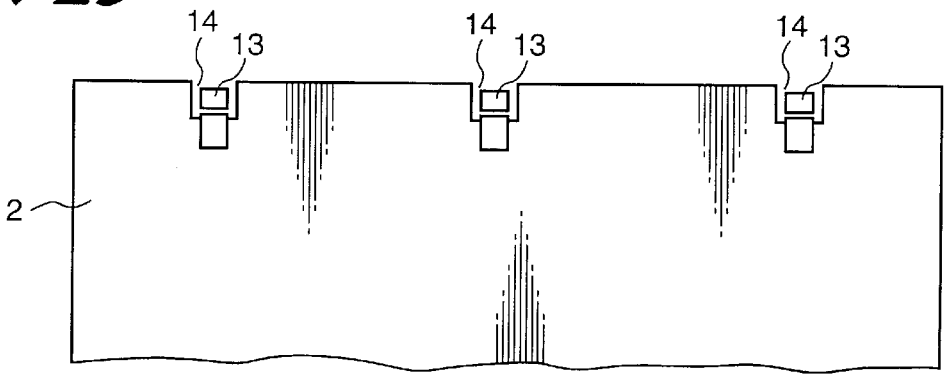
FIG. 19 is a plan view in which a plate is attached to a support.

Next, in the present invention, an example of fixing a plate which is being held by a vise with a support is explained. FIG. 18 is a perspective view of a plate 13, FIG. 19 is a plan view in which the plate 13 of FIG. 18 is attached to a support 21, and FIG. 20 is a sectional view showing that the support 21 to which the plate 13 is attached is fixed by a vise 32, a film base printing plate 1 is mounted and the tail edge of the printing plate 1 is covered by the plate 13.

The plate 13 comprises a material having at least a strength which is the same as that of steel, and the thickness thereof is made the same as or slightly thinner than that of a support. The width of the plate is 15 mm and two plane plates are connected with a step of 1 mm. At the tail edge of the support, a notch 14 which is the same size as that of the lower plane 13*a* of the plate 13 is provided, and the plate 13 is inserted into the notch so that the higher plane 13*b* faces towards the head portion of the lithoplate and is fixed by tape or the like.

When the support is mounted, the higher plane 13*b* or the plate projects onto the plate cylinder 10 mm, and the holding tail edge of the printing plate is inserted and fixed.

According to the first embodiment of the present invention, positioning error of a register pin can be canceled and a position adjusting operation of a lithoplate can be markedly reduced. Particularly in multi-color printing as in color printing, adjustment of a position of the lithoplate is extremely important and the effect of the present invention reveals itself remarkably. Also, mounting and removal of the lithoplate can be carried out rapidly and easily as compared with the conventional device. Particularly in a light printing which is the technical field of the present invention, change in lithoplates is carried out frequently so that efficiency in changing operation of the lithoplate can be markedly improved.

Further, according to the second embodiment or the present invention, a lithoplate having weak body and strength such as a paper plate or a film plate can be mounted rapidly and smoothly, and rising at the head edge of the mounted lithoplate can be effectively prevented whereby the lithoplate can be mounted easily on a plate cylinder packing.

Moreover, according to the last embodiment of the present invention, rising of the tail edge of the lithoplate can be suppressed to the extent that no problem occurs for effecting printing without impairing ease and simplicity as well as flexibility in lithoplate size in a mounting method of lithographic printing plate comprising a paper or a resin film.

We claim:

1. A method for mounting a lithoplate comprising a support of a paper or a plastic film, to a lithoplate mounting device comprising, the step of providing a plate cylinder for lithographic printing having a cutout portion with a head end and a tail end, the step of providing a head clamp disposed at said head end of said cutout portion of said plate cylinder, said head clamp having an upper blade and a lower blade, the step of providing a tail clamp disposed at said tail end of said cutout portion of said plate cylinder, said tail clamp having an upper blade and a lower blade, and the step of providing a register pin fixed to said lower blade of said head clamp, wherein said upper blade of said head clamp defines a hole that allows the register pin to pass completely through, said register pin being sufficiently long to extend entirely through said hole in said upper blade of said head clamp such that it has a portion that extends above an upper surface of said upper blade of said head clamp, which method further comprises the steps of:

clamping a plate cylinder packing to the head clamp and the tail clamp; and inserting the portion of said register pin that extends above said upper surface of said upper blade into a pin hole of said lithoplate, thus mounting the lithoplate to the device.

2. A method for mounting a lithoplate comprising a support of a paper or a plastic film, to a lithoplate mounting device comprising, the step of providing a plate cylinder for lithographic printing having a cutout portion with a head end and a tail end, the step of providing a head clamp disposed at said head end of said cutout portion of said plate cylinder, said head clamp having an upper blade and a lower blade, the step of providing a tail clamp disposed at said tail end of said cutout portion of said plate cylinder, said tail clamp having an upper blade and a lower blade, and the step of providing a register pin fixed to said lower blade of said head clamp, wherein said step of providing said head clamp, said upper blade defines a hole that allows the register pin to pass completely through, said register pin being sufficiently long to extend entirely through said hole in said upper blade of said head clamp such that it has a portion that extends above an upper surface of said upper blade of said head clamp, and wherein said step of providing said register pin, said portion of said register pin that extends above said upper blade of said head clamp has a head portion which is wider than a remaining portion of said register pin that can pass through a hole defined by a lithoplate, said head portion attaches said lithoplate to said plate cylinder to prevent said lithoplate from detaching in operation, which method further comprises the steps of:

clamping a plate cylinder packing to the head clamp and the tail clamp: and inserting the portion of said register pin that extends above said upper surface of said upper blade into a pin hole of said lithoplate, thus mounting the lithoplate to the device.

3. A method for mounting a lithoplate according to claim 2, wherein said step of providing a head portion the head portion has a shape that attaches said lithoplate to said plate cylinder and prevents said lithoplate from detaching in operation.

4. A method for mounting a lithoplate according to claim 2, wherein said step of providing a head portion the head portion has a v-shaped pin with a first configuration which can pass through a hole defined by a lithoplate, and a second configuration that prevents said lithoplate from detaching in operation.

5. A method for mounting a lithoplate comprising a support of a paper or a plastic film, to a lithoplate mounting device comprising, the step of providing a plate cylinder for lithographic printing having a cutout portion with a head end and a tail end, the step of providing a head clamp disposed at said head end of said cutout portion of said plate cylinder, said head clamp having an upper blade and a lower blade, the step of providing a tail clamp disposed at said tail end of said cutout portion of said plate cylinder, said tail clamp having an upper blade and a lower blade, and the step of providing a register pin fixed to said lower blade of said head clamp, the step of providing a roller disposed on an upper surface of said upper blade proximate to said register pin, wherein said roller can rotate freely about an axis of rotation, wherein said step of providing said head clamp, said upper blade defines a hole that allows the register pin to pass completely through, said register pin being sufficiently long to extend entirely through said hole in said upper blade of said head clamp such that it has a portion that extends above an upper surface of said upper blade of said head clamp, which method further comprises the steps of:

clamping a plate cylinder packing to the head clamp and the tail clamp: and inserting a head edge of the lithoplate along said roller, whereby inserting the portion of said register pin that extends above said upper surface of said upper blade into a pin hole of said lithoplate, thus mounting the lithoplate to the device.

6. A method for mounting a lithoplate comprising a support of a paper or a plastic film, to a lithoplate mounting device which comprises, the step of providing a plate cylinder for lithographic printing having a cutout portion with a head end and a tail end, the step of providing a head clamp disposed at said head end of said cutout portion of said plate cylinder, said head clamp having an upper blade and a lower blade, the step of providing a tail clamp disposed at said tail end of said cutout portion of said plate cylinder, said tail clamp having an upper blade and a lower blade for clamping a lithoplate, and the step of providing a covering member having a first end and a second end opposite said first end, said first end being attached at said upper blade of said tail clamp, said second end being projected at least 5 mm from an end of said upper blade of said tail clamp, which method further comprises the steps of:

clamping a support to said head clamp and said tail clamp; and mounting the lithoplate to the device so as to cover at least a part of the lithoplate tail edge by the portion projected from the end of the upper blade of said covering member.

7. A method for mounting a lithoplate according to claim 6, wherein said step of providing said covering member, said covering member is a plate member.

8. A method for mounting a lithoplate according to claim 7, wherein said step of providing said covering member, said plate member is formed of a material selected from the group consisting of a metal and a plastic.

* * * * *